US007146838B1

(12) United States Patent
Kihara et al.

(10) Patent No.: US 7,146,838 B1
(45) Date of Patent: Dec. 12, 2006

(54) METHOD OF AND APPARATUS FOR FORMING TOOTH PROFILE

(75) Inventors: Takashi Kihara, Tochigi-ken (JP); Yoichi Uehara, Fujimino (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/270,516

(22) Filed: Nov. 10, 2005

(51) Int. Cl.
*B21J 13/00* (2006.01)

(52) U.S. Cl. ..... 72/355.4; 72/352

(58) Field of Classification Search ..... 29/893, 29/893.34; 72/344, 352, 353.2, 354.2, 355.4, 72/356, 358, 359, 377, 355.2
See application file for complete search history.

(56) References Cited

U.S. PATENT DOCUMENTS 4,245,491 A * 1/1981 Kondo et al. ..... 72/356
6,178,801 B1 * 1/2001 Ishida ..... 72/354.2
7,047,787 B1 * 5/2006 Kanemitsu et al. ..... 72/355.4

FOREIGN PATENT DOCUMENTS

JP 4-313442 11/1992
JP 6-212208 A 8/1994

* cited by examiner

*Primary Examiner*—Lowell A. Larson
*Assistant Examiner*—Teresa M. Bonk
(74) *Attorney, Agent, or Firm*—Arent Fox PLLC

(57) ABSTRACT

A punch fixed to a body assembly is inserted into a hole in a workpiece, and the workpiece is pressed by an upper die to press a splining segment of the punch into the hole in the workpiece, thereby forming spline slots in the inner circumferential surface of the hole in the workpiece. After the spline slots have been formed, the lower surface of the workpiece around the hole is held on a second lower die, and the upper surface of an outer circumferential edge portion of the workpiece is pressed by the upper die to cause the hole in the workpiece to have desired dimensional accuracy.

15 Claims, 8 Drawing Sheets

METHOD OF AND APPARATUS FOR FORMING TOOTH PROFILE

BACKGROUND OF THE INVENTION

1. Field of the Invention

The present invention relates to a method of and an apparatus for forming a tooth profile by applying a pressure to a forging blank.

2. Description of the Related Art

There has been known a tooth profile forming apparatus for sizing unprocessed internal teeth, which have been formed in a workpiece and have not yet been processed into a complete tooth profile, to desired shapes and dimensions.

The known tooth profile forming apparatus has a lower punch which is axially movable upwardly, an upper punch which is axially movable downwardly, and first through third core rods disposed axially in line in the lower punch. The first through third core rods have a dedendum correcting surface, a tooth profile correcting surface, and an addendum correcting surface, respectively, on their outer circumferential surfaces for correcting unprocessed internal teeth.

When the unprocessed internal teeth in the workpiece are pressed successively onto the first through third core rods by the upper punch, the internal teeth are corrected stepwise into internal teeth having desired dimensions.

Specifically, when the first core rod with the dedendum correcting surface is pressed into the unprocessed internal teeth, the internal teeth are machined thereby to have root surfaces. When the second core rod with the tooth profile correcting surface is pressed into the unprocessed internal teeth, the internal teeth are machined thereby to have tooth profile surfaces. When the third core rod with the addendum correcting surface is pressed into the unprocessed internal teeth, the internal teeth are machined thereby to have tip surfaces. For details, reference should be made to Japanese Laid-Open Patent Publication No. 6-212208, for example.

In the tooth profile forming apparatus according to the conventional technique, when the workpiece with the unprocessed internal teeth is displaced downwardly onto the first through third core rods by the upper punch, the material of the unprocessed internal teeth plastically flows upwardly in the axial direction of the workpiece. At this time, the internal teeth formed when the unprocessed internal teeth are corrected by the first through third core rods tend to have dimensional variations. Specifically, when the internal teeth are formed, they are tapered upwardly in the axial direction and suffer reduced dimensional accuracy. As a result, the internal teeth fail to have desired dimensions.

Furthermore, in order to form internal teeth in a workpiece, it is necessary for the workpiece to have unprocessed internal teeth before the workpiece is machined by the tooth profile forming apparatus. After the workpiece is machined to have unprocessed internal teeth by another forging apparatus, the workpiece needs to be delivered to the tooth profile forming apparatus for correcting the unprocessed internal teeth. The process of delivering the workpiece from one apparatus to another is time-consuming and troublesome.

SUMMARY OF THE INVENTION

It is a general object of the present invention to provide a method of and an apparatus for forming a tooth profile to generate spline slots in a hole defined in a workpiece by forging while keeping desired dimensional accuracy of the hole.

The above and other objects, features, and advantages of the present invention will become more apparent from the following description when taken in conjunction with the accompanying drawings in which a preferred embodiment of the present invention is shown by way of illustrative example.

DESCRIPTION OF THE PREFERRED EMBODIMENT

Figure 1:
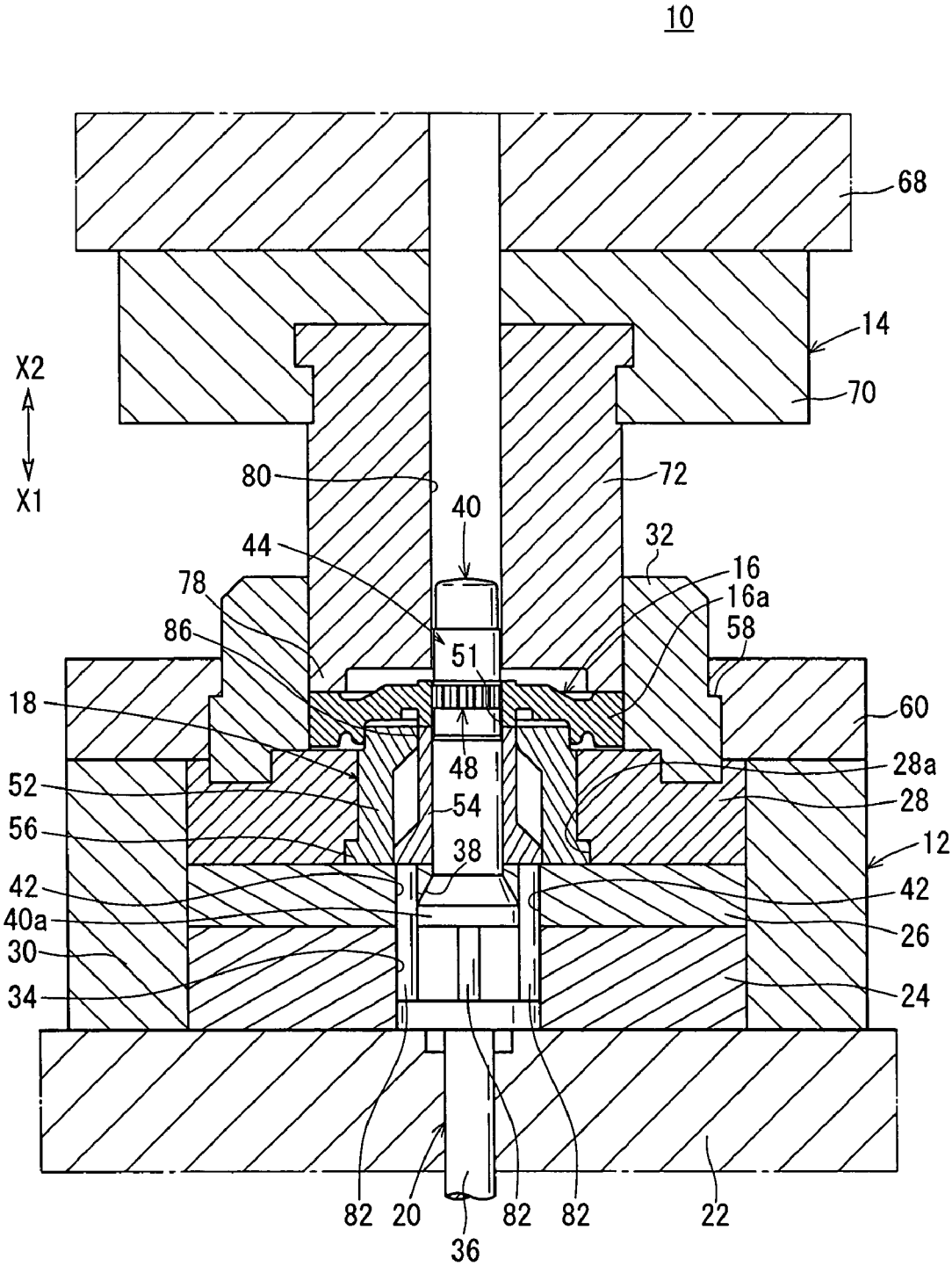
FIG. 1 is a vertical cross-sectional view of a tooth profile forming apparatus according to an embodiment of the present invention.

FIG. 1 shows a tooth profile forming apparatus 10 according to an embodiment of the present invention. As shown in FIG. 1, the tooth profile forming apparatus 10 comprises a body assembly 12, an actuator 14 which can be displaced in an axial direction thereof when pressed by a drive source (not shown), a die assembly 18 in which a workpiece 16 to be forged is placed, and a workpiece ejecting mechanism 20 for pressing the workpiece 16, the workpiece ejecting mechanism 20 being displaceable in an axial direction of the body assembly 12. The workpiece 16 has a hole 51 defined substantially centrally therein and extending axially therethrough.

The body assembly 12 has a plate-like first base 24 mounted on an upper surface of a foundation 22, a plate-like punch holder 26 holding a punch 40 to be described later, a second base 28 mounted on the upper surface of the punch holder 26, a fixing member 30 disposed around the first base 24, the punch holder 26, and the second base 28 and holding the first base 24, the punch holder 26, and the second base 28 integrally together, and an annular outer ring 32 engaging an upper surface of the second base 28.

The first base 24 has a through hole 34 defined substantially centrally therein and extending along the axial direction of the body assembly 12. A shaft 36 is vertically movably supported in the foundation 22 in alignment with the through hole 34, and is movable upwardly into the through hole 34.

The punch holder 26 has an engaging hole 38 defined substantially centrally therein in communication with the through hole 34. The engaging hole 38 has a diameter progressively greater toward the through hole 34. The punch 40 has a lower end engaging in the engaging hole 38.

The punch holder 26 has a plurality of insertion holes 42 defined therein which are spaced radially outwardly from the engaging hole 38 and disposed at circumferentially spaced intervals around the engaging hole 38. The insertion holes 42 extend axially through the punch holder 26 and are held in communication with the through hole 34 in the first base 24.

The punch 40 has a radially outwardly enlarged flange 40*a* on its lower end which engages in the engaging hole 38 and a shank 44 formed on its upper end having a diameter smaller than the enlarged flange 40*a*. The punch 40 is vertically oriented with the enlarged flange 40*a* directed downwardly and the shank 44 directed upwardly. The enlarged flange 40*a* has a lower end face held against an upper surface of the first base 24, and is clamped between the engaging hole 38 and the upper surface of the first base 24.

As shown in FIGS. 2 through 5, the shank 44 has a guide segment 46 disposed adjacent to the enlarged flange 40*a* for guiding a second lower die 54 to be described later, a splining segment 48 disposed upwardly of the guide segment 46 and having a plurality of splining grooves 47 extending axially thereof, a large-diameter segment 49 disposed upwardly of the splining segment 48, and a small-diameter segment 50 disposed upwardly of the large-diameter segment 49.

Figure 2:
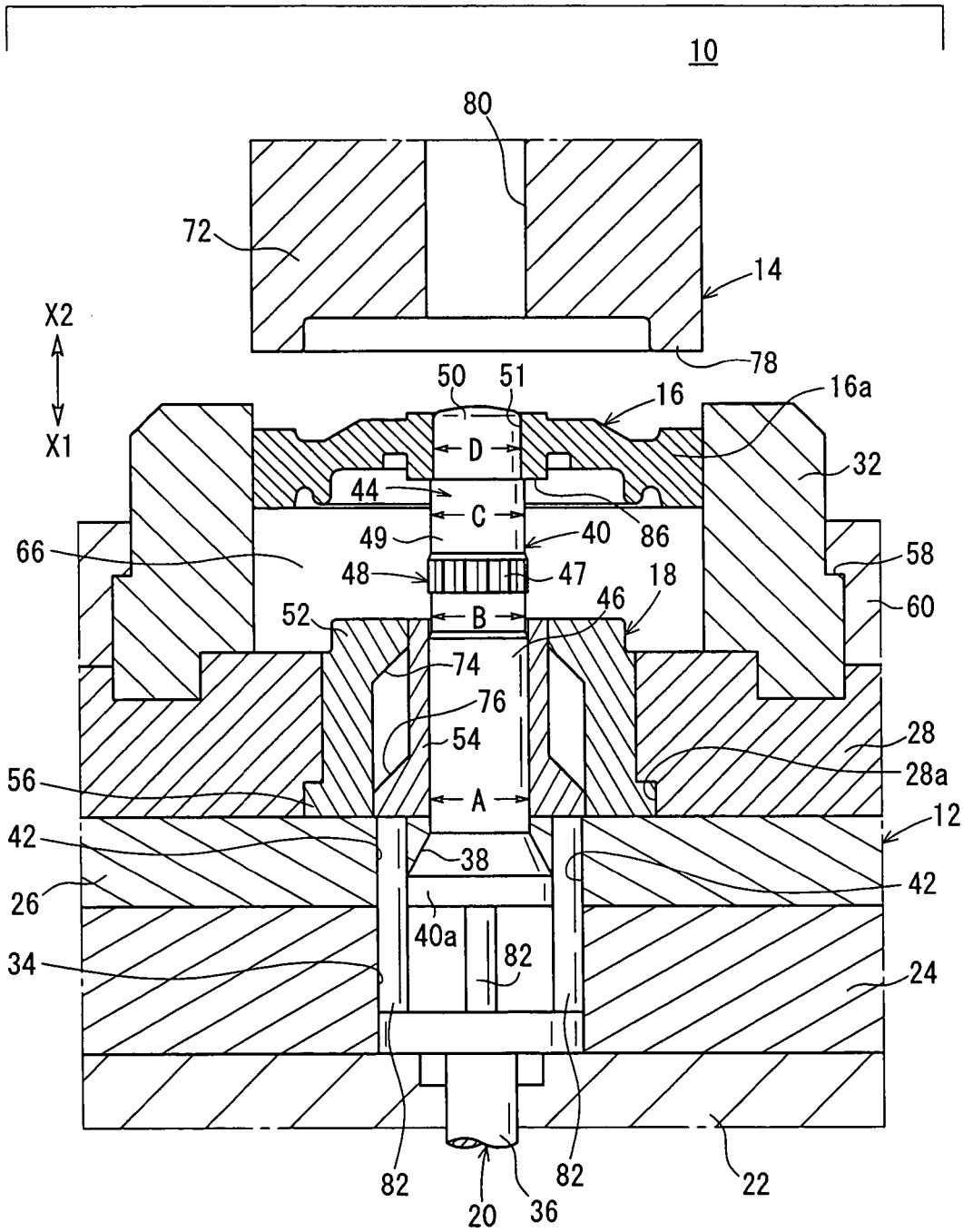
FIG. 2 is a vertical cross-sectional view showing the manner in which an actuator of the tooth profile forming apparatus is displaced upwardly and a workpiece is pressed over a small-diameter segment of a punch in the tooth profile forming apparatus.

As shown in FIG. 2, the guide segment 46, the splining segment 48, the large-diameter segment 49, and the small-diameter segment 50 have respective diameters A, B, C, D which are successively smaller in the order named (A>B>C>D). The diameter D of the small-diameter segment 50 is substantially the same as the inside diameter of the hole 51 in the workpiece 16 in which the small-diameter segment 50 is inserted.

The splining grooves 47 are defined axially in the outer circumferential surface of the splining segment 48 and have respective axial lengths substantially equal to or slightly longer than the axial length of the hole 51 in the workpiece 16.

The die assembly 18 has a first lower die 52 and a second lower die 54 which are mounted substantially centrally in the second base 28. The first lower die 52 and the second lower die 54 function as a second die unit for holding a lower portion of the workpiece 16.

The second base 28 has a groove 28*a* defined in an inner circumferential surface thereof and having a predetermined depth in the radially outward direction. The first lower die 52 has a ledge 56 projecting radially outwardly and engaging in the groove 28*a*. The ledge 56 engaging in the groove 28*a* prevents the first lower die 52 from being displaced axially.

The outer ring 32 has a step 58 projecting radially outwardly on an outer circumferential surface thereof and engaged by an engaging member 60, which is fastened to the fixing member 30 by bolts (not shown). The fixing member 30 and the engaging member 60 jointly secure the first and second bases 24, 28, the punch holder 26, and the outer ring 32 to the foundation 22.

The outer ring 32 has an inner circumferential surface having a diameter which is substantially the same as the diameter of the outer circumferential surface of the workpiece 16 that is loaded in the outer ring 32.

The outer ring 32 and upper surfaces of the first and second lower dies 52, 54 jointly define a workpiece cavity 66 surrounded thereby. The workpiece 16, e.g., a forged workpiece such as a transmission gear or the like, is loaded in the workpiece cavity 66. The hole 51 in the workpiece 16 has an inside diameter which is substantially the same as the diameter D of the small-diameter segment 50 of the punch 40. The diameter of the outer circumferential surface of the workpiece 16 is substantially the same as the inside diameter of the outer ring 32.

The actuator 14 comprises a plate member 68 to which a pressure is applied axially when the drive source (not shown) is energized, and a connector 70 integrally fastened to a lower surface of the plate member 68 by bolts (not shown). The die assembly 18 includes an upper die (upper die unit) 72 connected substantially centrally to the connector 70 and projecting downwardly. When the non-illustrated drive source is energized, the plate member 68, the connector 70, and the upper die 72 are displaced axially in unison with each other. The upper die 72 cooperates with the outer ring 32 and the first and second lower dies 52, 54 in defining the workpiece cavity 66.

Therefore, the die assembly 18 includes the first and second lower dies 52, 54 disposed in the second base 28 and the upper die 72 coupled to the connector 70.

The first lower die 52 has its outer circumferential surface held against the inner circumferential surface of the second base 28, and the ledge 56 projecting from the outer circumferential surface of the first lower die 52 engages in the groove 28*a* in the second base 28.

The first lower die 52 has its lower end face held against the upper surface of the punch holder 26 and hence is prevented from being displaced axially. The first lower die 52 has a first slanted surface 74 on its upper portion which is inclined a predetermined angle and extends progressively radially inwardly from the inner circumferential surface of the first lower die 52.

The second lower die 54 is disposed radially inwardly of the inner circumferential surface of the first lower die 52 and can be displaced axially with respect to the first lower die 52. The second lower die 54 has an outer circumferential surface slidably held against the inner circumferential surface of the first lower die 52. Namely, the second lower die 54 has an inner circumferential surface slidable axially along the outer circumferential surface of the guide segment 46 of the punch 40. The outer circumferential surface of the second lower die 54 is slidable axially along the inner circumferential surface of the first lower die 52.

The second lower die 54 has a second slanted surface 76 on its lower portion which is inclined a predetermined angle and extends progressively radially outwardly from the outer circumferential surface of the second lower die 54. The angles of the second slanted surface 76 and the first slanted surface 74 of the first lower die 52 with respect to the axis of the first and second lower dies 52, 54 are substantially the same as each other so that when the second lower die 54 is displaced upwardly by the shaft 36, the second slanted surface 76 and the first slanted surface 74 are held in contact with each other.

When the second lower die 54 is displaced upwardly, the second slanted surface 76 is brought into contact with the first slanted surface 74, preventing the second lower die 54 from being further displaced upwardly. Therefore, the second lower die 54 is prevented from being further displaced upwardly when the second slanted surface 76 and the first slanted surface 74 are held in contact with each other.

The first and second lower dies 52, 54 have substantially the same axial lengths when the lower surfaces of the first and second lower dies 52, 54 are held against the upper surface of the punch holder 26.

The upper die 72 which engages a lower portion of the connector 70 projects downwardly, and includes an annular ridge 78 projecting a predetermined distance from a lower end face of the upper die 72 toward the second base 28. The annular ridge 78 is formed along an outer circumferential edge of the upper die 72.

The upper die 72 has a through hole 80 defined substantially centrally therein which axially extends through the upper die 72. When the upper die 72 is displaced downwardly, the small-diameter segment 50 of the punch 40 is inserted into the through hole 80 in the upper die 72. The through hole 80 has a diameter greater than the diameter D of the small-diameter segment 50.

The workpiece ejecting mechanism 20 includes the shaft 36 extending into the through hole 34 in the first base 24, and a plurality of ejector pins 82 projecting from an upper end face of the shaft 36 toward the die assembly 18.

The shaft 36 has a flange on its upper end extending radially outwardly and having a diameter which is substantially the same as the diameter of the through hole 34. The ejector pins 82 are mounted on the flange of the shaft 36 along an outer circumferential edge thereof. The ejector pins 82 extend through the through hole 34 displaceably into the respective insertion holes 42 in the punch holder 26. The ejector pins 82 have respective upper end faces held against the lower surface of the second lower die 54.

The tooth profile forming apparatus 10 according to the embodiment of the present invention is basically constructed as described above. Operation and advantages of the tooth profile forming apparatus 10 will be described below.

First, a process of forming spline slots 84 (tooth profile) in the hole 51 in the workpiece 16 which has been forged to a desired shape, e.g., a transmission gear, in advance, will be described below. The position of the parts of the tooth profile forming apparatus 10 when the actuator 14 is displaced upwardly and hence the upper die 72 is displaced upwardly is referred to as an initial position (see FIG. 2).

As shown in FIG. 2, the small-diameter segment 50 of the punch 40 is placed in the hole 51 in the workpiece 16, serving as a forging blank, in the initial position. Since the diameter C of the large-diameter segment 49 beneath the small-diameter segment 50 is greater than the diameter D of the small-diameter segment 50, the workpiece 16 placed on the small-diameter segment 50 is prevented from being displaced downwardly in the direction indicated by the arrow X1 by the large-diameter segment 49. Consequently, the workpiece 16 is retained in position on the small-diameter segment 50 above the large-diameter segment 49.

Figure 3:
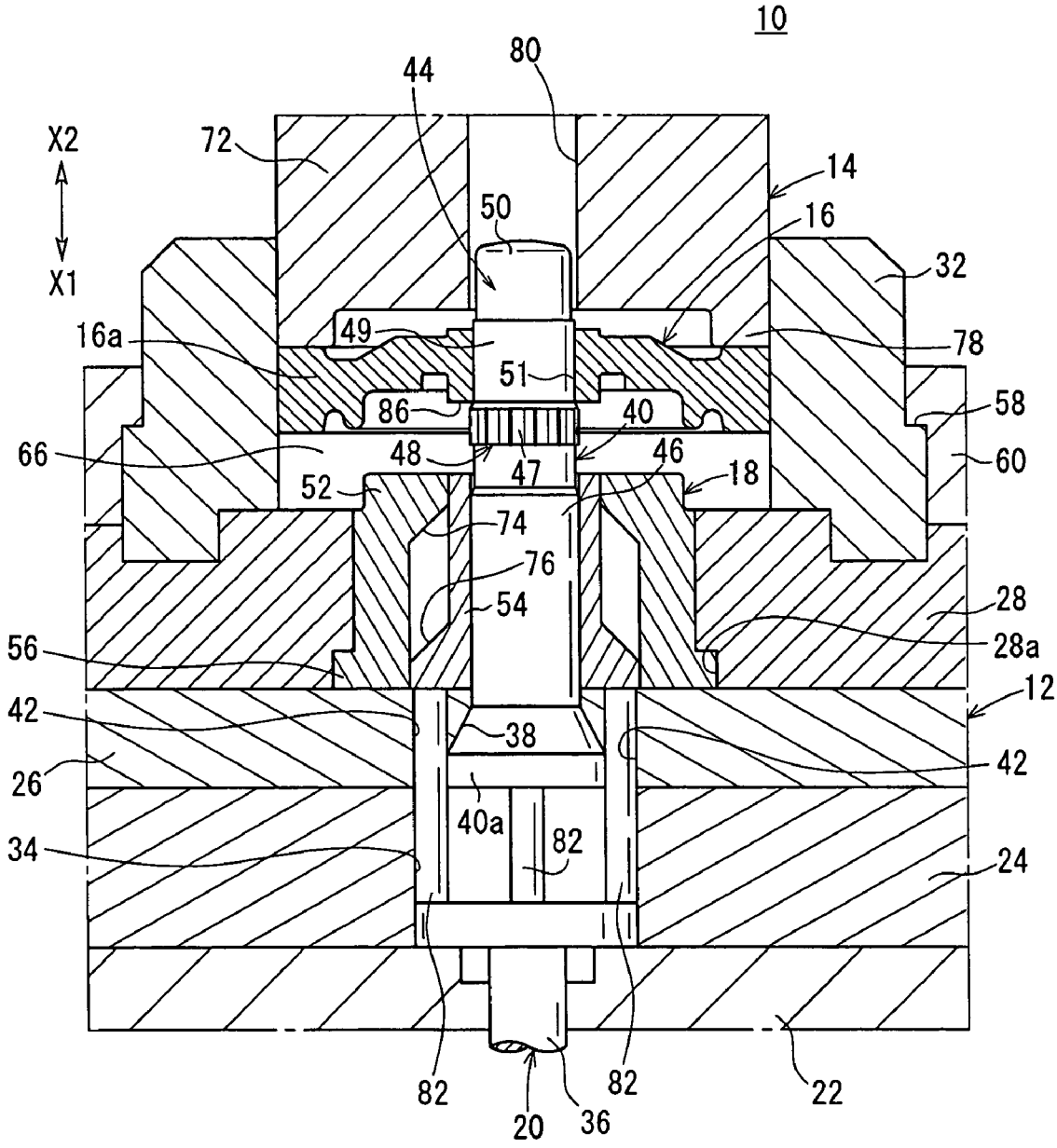
FIG. 3 is a vertical cross-sectional view showing the manner in which the actuator shown in FIG. 2 is displaced downwardly against an upper surface of the workpiece and the workpiece is pressed over a large-diameter segment of the punch.
Figure 4:
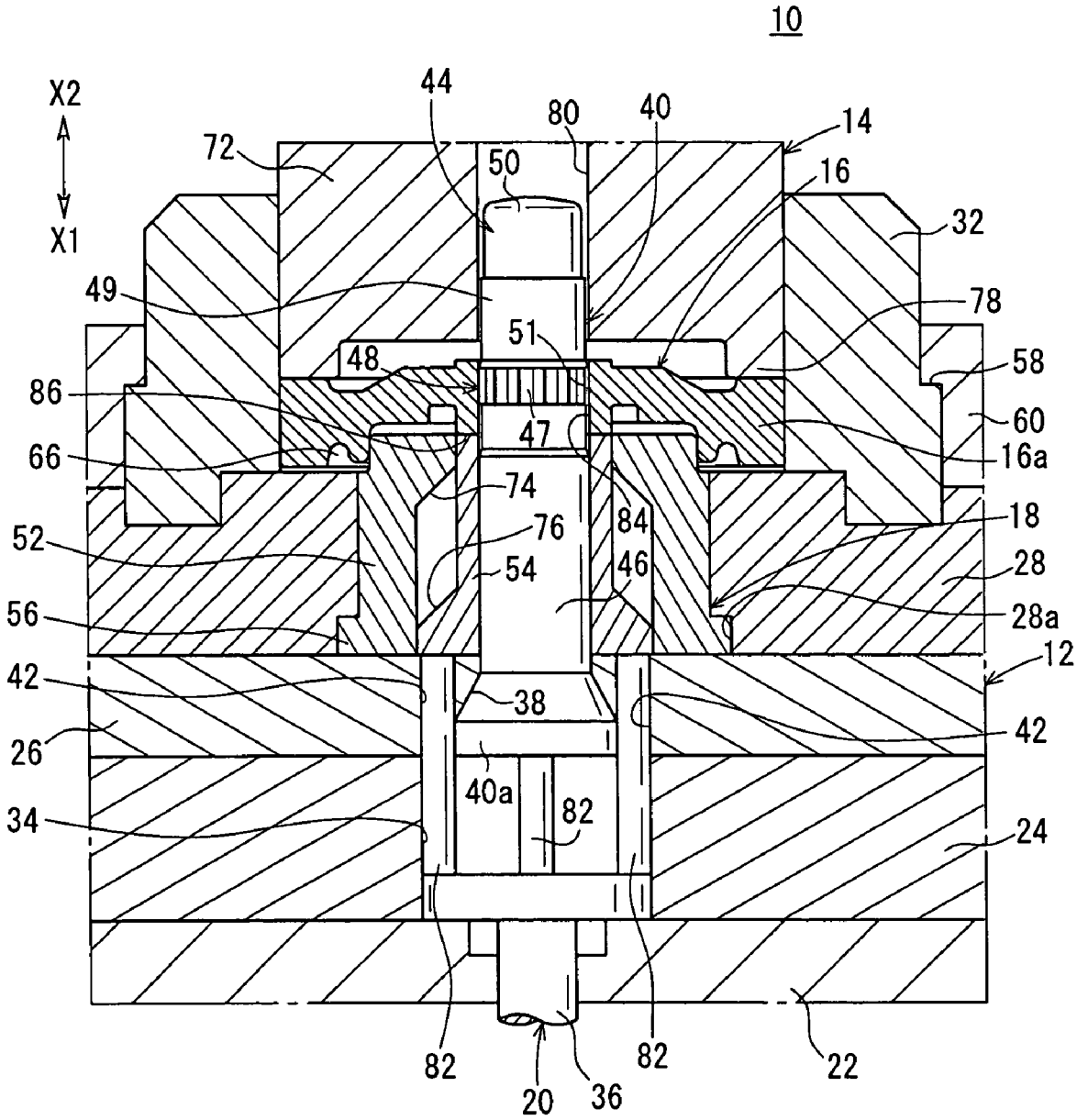
FIG. 4 is a vertical cross-sectional view showing the manner in which the workpiece is further pressed downwardly by the actuator shown in FIG. 3 and the workpiece is pressed over a splining segment of the punch to form spline slots in the workpiece.
Figure 5:
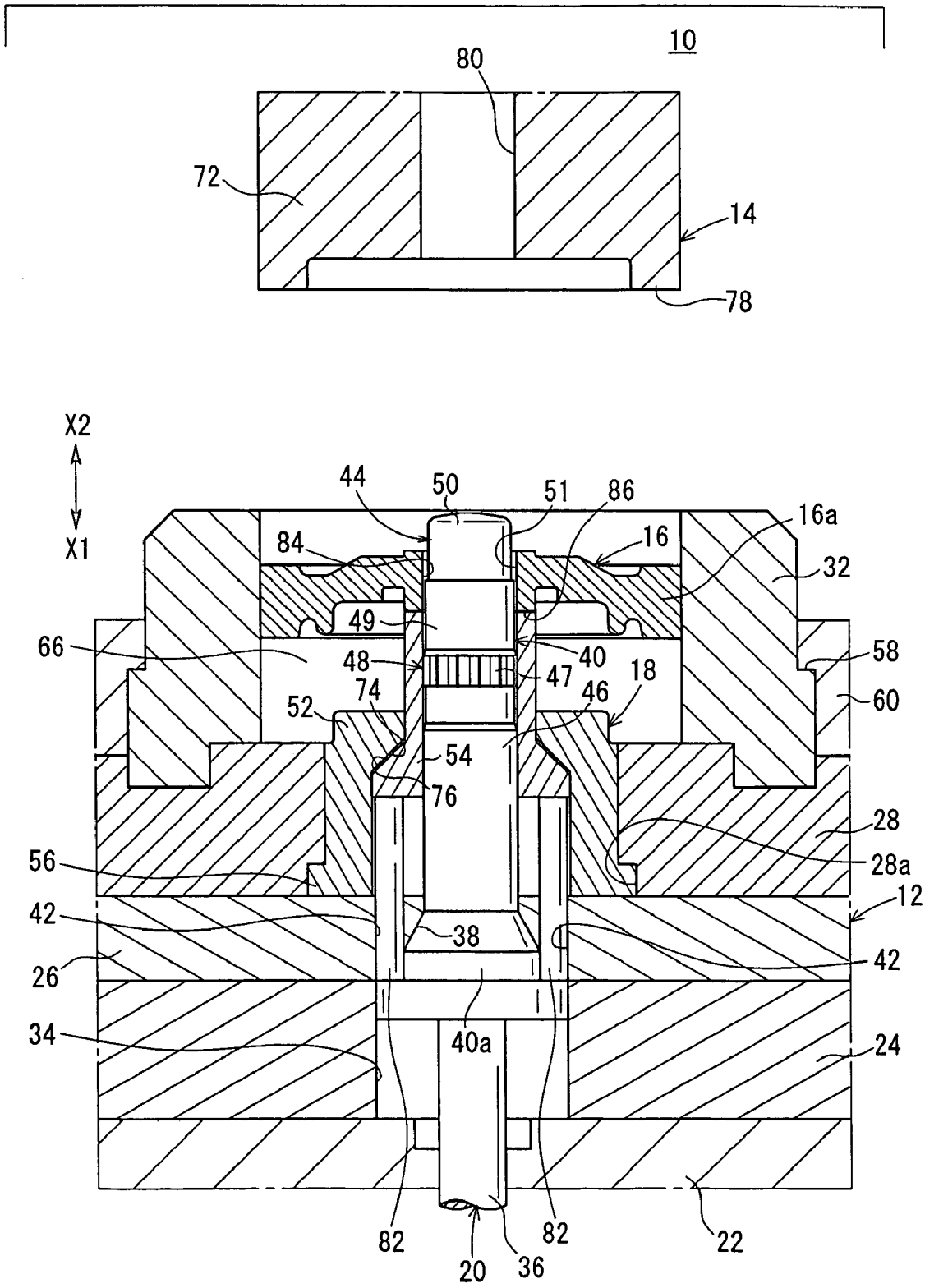
FIG. 5 is a vertical cross-sectional view showing the manner in which the workpiece is ejected out of a workpiece cavity by ejector pins after the spline slots are formed in the workpiece.

When a power supply, not shown, supplies an electric current to the non-illustrated drive source, the plate member 68 and the connector 70 are displaced axially downwardly in unison with each other in the direction indicated by the arrow X1 as shown in FIG. 1. When the ridge 78 of the upper die 72 engages the upper surface of the workpiece 16 along an outer circumferential edge portion 16*a* thereof and the actuator 14 (see FIG. 1) is further displaced downwardly, as shown in FIG. 3, the workpiece 16 is pressed and displaced axially downwardly in the direction indicated by the arrow X1 by the ridge 78 of the upper die 72.

At this time, the large-diameter segment 49 beneath the small-diameter segment 50 is forcibly pressed into the hole 51 in the workpiece 16, which is spread radially outwardly.

When the upper die 72 is further displaced axially downwardly in the direction indicated by the arrow X1 by the actuator 14, the workpiece 16 is pressed axially downwardly by the ridge 78 of the upper die 72, and the splining segment 48 beneath the large-diameter segment 49 is forcibly inserted into the hole 51 in the workpiece 16. Because the inner circumferential diameter of the splining grooves 47 of the splining segment 48 is greater than the inner circumferential diameter of the hole 51 in the workpiece 16, the splining segment 48 is pressed into the hole 51 (see FIG. 4).

Figure 6:
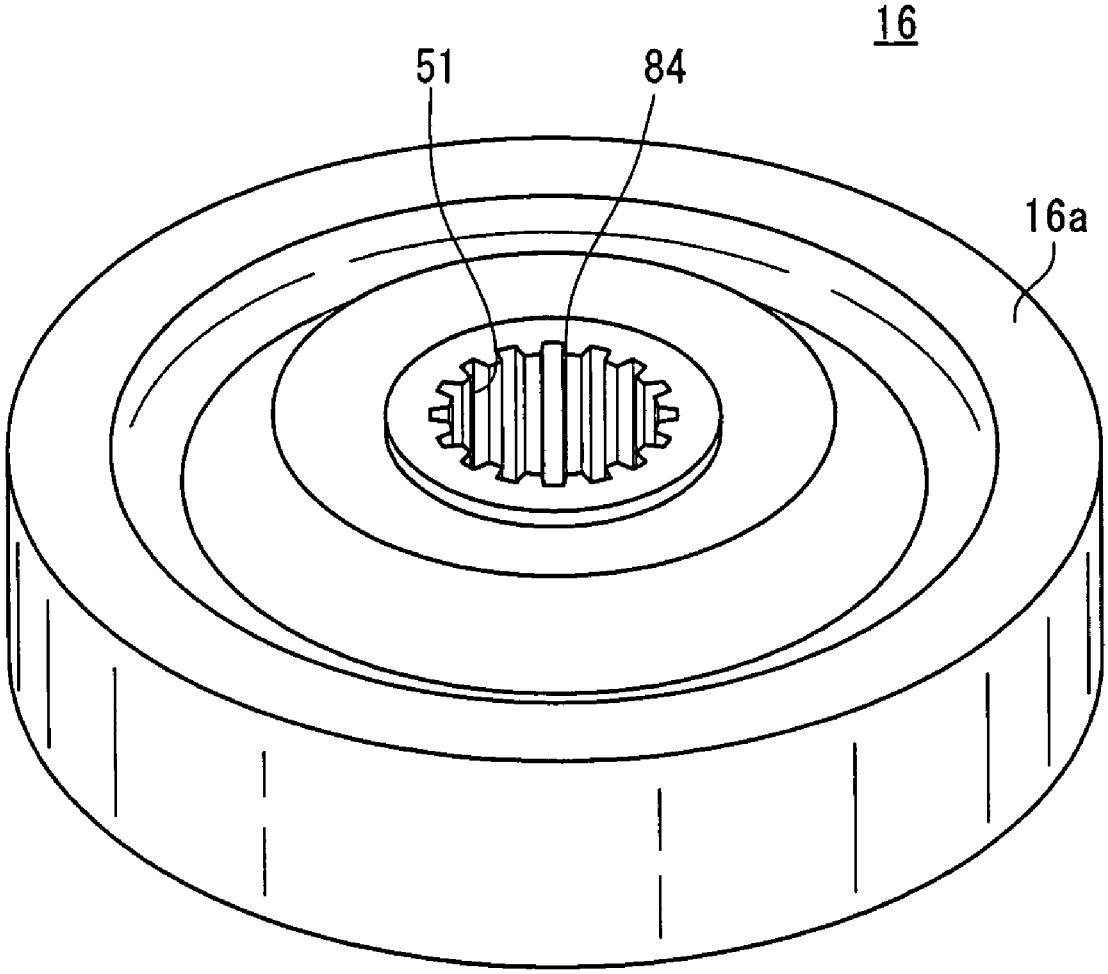
FIG. 6 is a perspective view of the workpiece with the spline slots formed in the hole thereof.

The material of the workpiece 16 around the hole 51 plastically flows by being pushed upwardly by the teeth between the splining grooves 47 of the splining segment 48, forming spline slots 84 (tooth profile) in the inner circumferential surface of the hole 51 in the workpiece 16 (see FIG. 6).

When the workpiece 16 has its lower end face 86 around the hole 51 held against the upper surface of the second lower die 54, the downward displacement of the workpiece 16 is stopped at a lower displacement stroke end. The process of forming spline slots 84 in the inner circumferential surface of the hole 51 in the workpiece 16 is completed (see FIG. 4).

When the spline slots 84 are formed in the inner circumferential surface of the hole 51, since the material of the workpiece 16 around the hole 51 plastically flows by being pushed upwardly by the teeth between the splining grooves 47 of the splining segment 48, the diameter of the hole 51 tends to vary between the upper and lower portions of the hole 51 in the axial direction.

Figure 7:
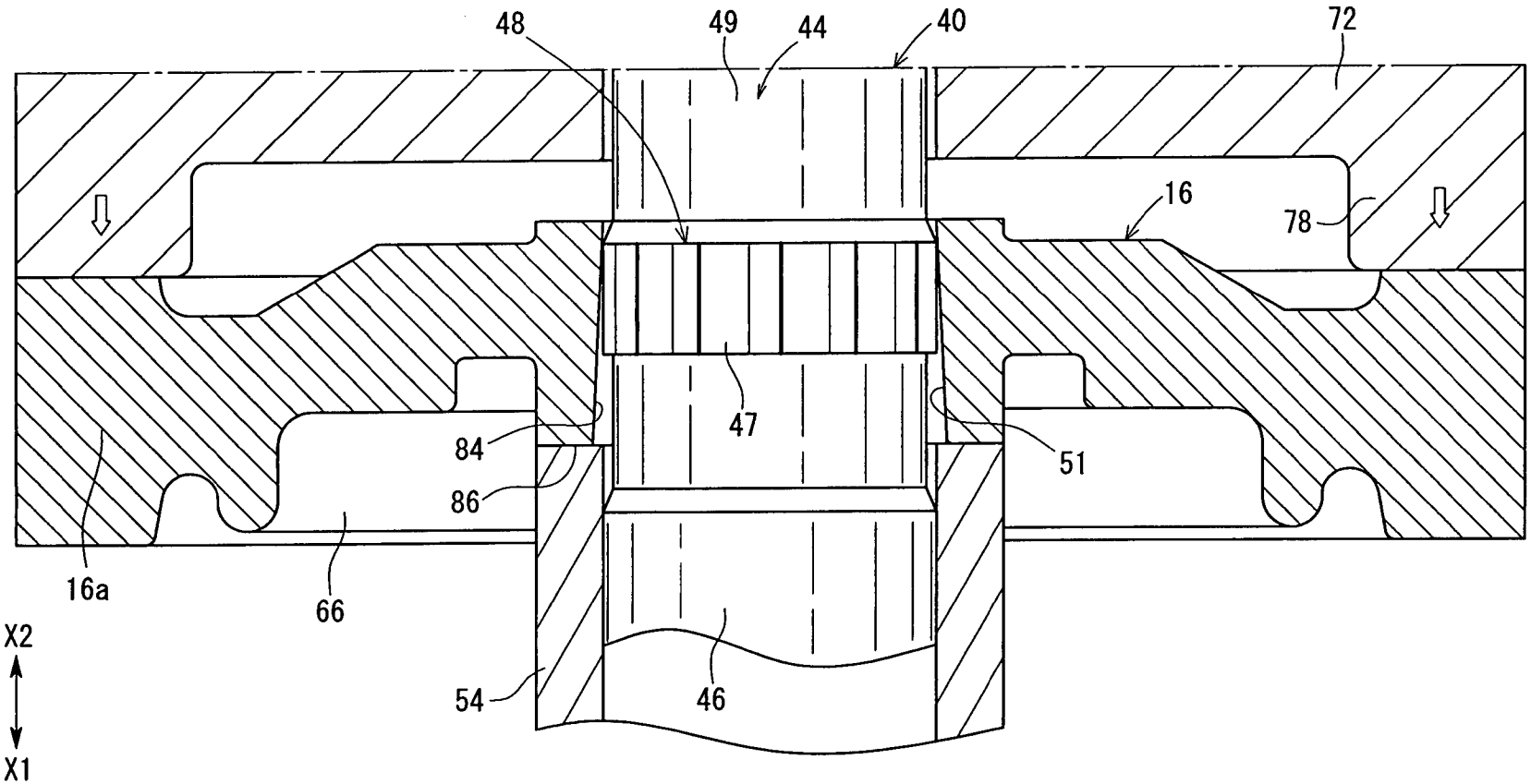
FIG. 7 is an enlarged fragmentary vertical cross-sectional view showing the manner in which the workpiece is pressed over the splining segment of the punch.

Specifically, the diameter of the hole 51 is made progressively smaller upwardly due to the material that has plastically flowed upwardly (see FIG. 7). Stated otherwise, the inner circumferential surface of the hole 51 in which the spline slots 84 have been formed is progressively tapered upwardly, i.e., has its diameter progressively smaller upwardly.

A process of correcting the tapered inner circumferential surface of the hole 51 so that the hole 51 will have a substantially constant diameter throughout its axial length will be described below.

First, as shown in FIG. 7, after the spline slots 84 have been formed in the inner circumferential surface of the hole 51 in the workpiece 16, the upper die 72 is further displaced downwardly in the direction indicated by the arrow X1 by the actuator 14. At this time, the workpiece 16 has its lower end face 86 around the hole 51 held on the upper surface of the second lower die 54.

Figure 8:
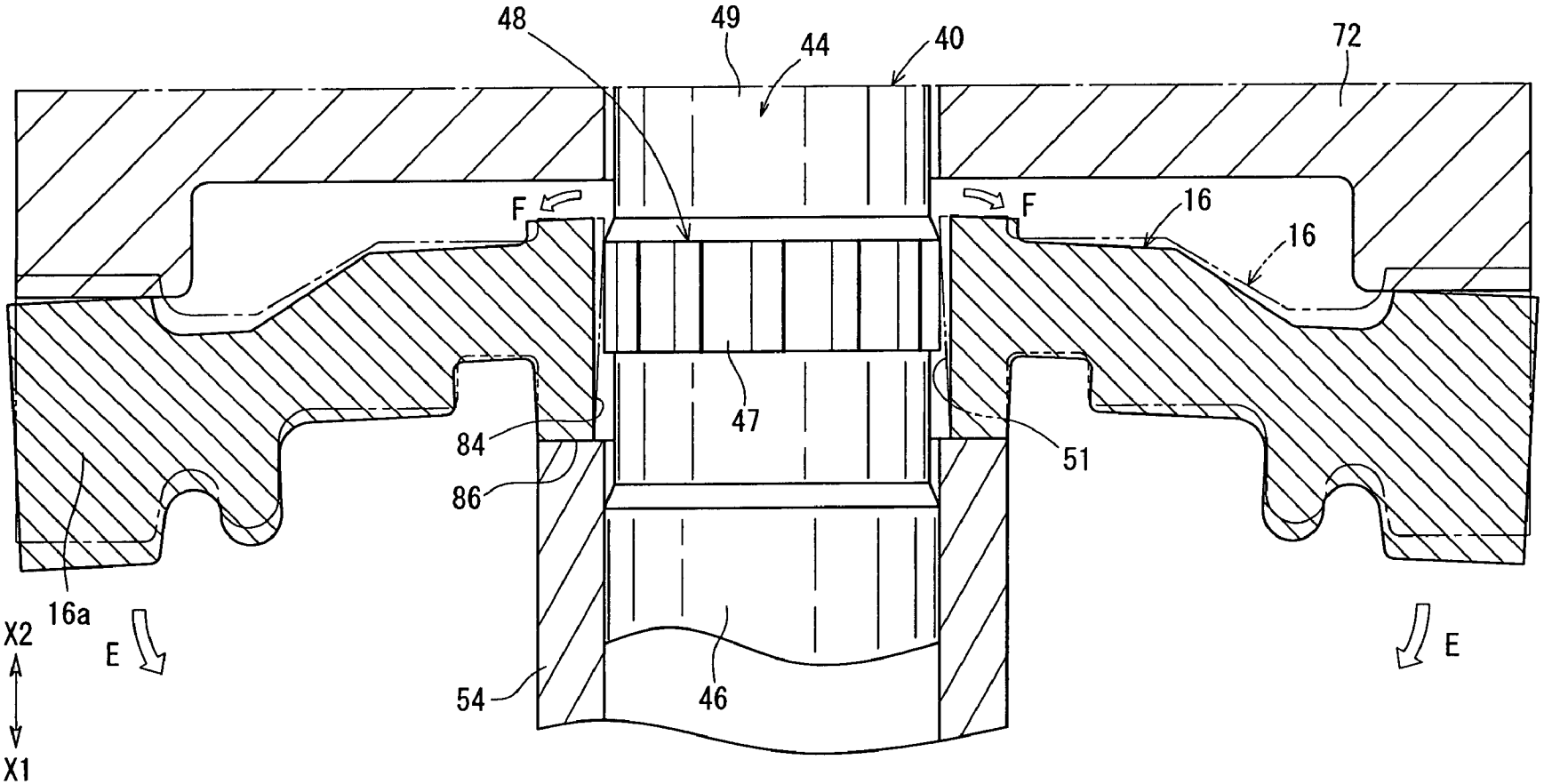
FIG. 8 is an enlarged fragmentary vertical cross-sectional view showing the manner in which the workpiece is corrected by being pressed by an upper die after the spline slots are formed in the workpiece.

When the upper die 72 is displaced downwardly, the outer circumferential edge portion 16*a* of the workpiece 16 is pressed downwardly in the direction indicated by the arrow X1 by the ridge 78 of the upper die 72. Since the lower end face 86 of the workpiece 16 around the hole 51 is prevented from being displaced axially downwardly by the second lower die 54, a moment acts on the outer circumferential edge portion 16*a* of the workpiece 16 to displace the outer circumferential edge portion 16*a* of the workpiece 16 downwardly about the inner circumferential edge of the workpiece 16, in the directions indicated by the arrows E in FIG. 8. At the same time, another moment acts on an axially upper portion of the workpiece 16 around the hole 51 to displace the upper portion of the workpiece 16 around the hole 51 away from the shank 44 of the punch 40, in the directions indicated by the arrows F in FIG. 8.

As a result, the inner circumferential surface of the hole 51 is corrected from the tapered shape into a shape substantially parallel to the axis of the hole 51 so that the hole 51 has a substantially constant diameter throughout its axial length.

Depending on variations of the diameter of the hole 51, i.e., the angle at which the inner circumferential surface of the hole 51 is inclined toward the axis of the hole 51, the pressure applied by the non-illustrated drive source from the upper die 72 to the workpiece 16 may be adjusted to adjust the moments acting on the workpiece 16. Specifically, the pressure applied from the upper die 72 to the workpiece 16 may be adjusted to bring the inner circumferential surface of the hole 51 substantially parallel to the axis of the hole 51 so that the hole 51 has a substantially constant diameter throughout its axial length.

Finally, after the spline slots 84 have been formed in the inner circumferential surface of the hole 51 in the workpiece 16 and the inner circumferential surface of the hole 51 has been corrected to have a substantially constant diameter, the workpiece 16 is removed from the workpiece cavity 66 as follows. The plate member 68 is displaced upwardly by the non-illustrated drive source to displace the connector 70 and the upper die 72 in unison with each other upwardly in the direction indicated by the arrow X2 (see FIG. 5).

Then, the shaft 36 extending into the first base 24 is displaced upwardly in the direction indicated by the arrow X2 by a drive source (not shown), causing the ejector pins 82 on the shaft 36 to displace the second lower die 54 axially upwardly. At this time, the second lower die 54 is guided by the guide segment 46 of the punch 40. The second lower die 54 pushes the lower end face 86 of the workpiece 16 around the hole 51 upwardly in the direction indicated by the arrow X2, whereupon the workpiece 16 is displaced upwardly in the direction indicated by the arrow X2 along the inner circumferential surface of the outer ring 32 until the workpiece 16 is removed from the workpiece cavity 66.

After the spline slots 84 have been formed in the inner circumferential surface of the hole 51 in the workpiece 16, the spline slots 84 are heated to a high temperature for increasing the mechanical strength thereof. The high-temperature heat treatment may possibly cause thermal strains which may bring about dimensional variations in the diameter of the hole 51. Therefore it is preferable that the tapered inner circumferential surface of the hole 51 is corrected in view of dimensional variations in the diameter of the hole 51 which may be caused by the thermal strains. Consequently, even after the spline slots 84 have been heated, the diameter of the hole 51 may be set to desired dimensions highly accurately.

According to the above embodiment, the punch 40 has on its outer circumferential surface the splining segment 48 including the splining grooves 47, and the workpiece 16 is pressed over the splining segment 48 by the upper die 72. Therefore, the spline slots 84 can easily be formed in the inner circumferential surface of the hole 51 in the workpiece 16 by the splining segment 48. Stated otherwise, the spline slots 84 can easily be formed in the inner circumferential surface of the hole 51 simply by the splining segment 48 on the punch 40.

When the slots 84 are formed in the inner circumferential surface of the hole 51 in the workpiece 16 by forging, the material of the workpiece 16 around the hole 51 plastically flows axially upwardly, tending to cause dimensional variations in the diameter of the hole 51. Specifically, the inner circumferential surface of the hole 51 is progressively tapered upwardly, i.e., has its diameter progressively smaller upwardly.

To correct the tapered inner circumferential surface of the hole 51, the lower end face 86 of the workpiece 16 around the hole 51 is held on the upper surface of the second lower die 54 and the outer circumferential portion of the workpiece 16 is pressed downwardly by the ridge 78 of the upper die 72, generating a moment on the outer circumferential portion of the workpiece 16 about the lower end face 86 of the workpiece 16 around the hole 51 and also a moment on the axially upper portion of the workpiece 16 around the hole 51, displacing the axially upper portion of the workpiece 16 around the hole 51 away from the shank 44 of the punch 40. In this manner, the diameter of the hole 51 is corrected into a substantially constant diameter throughout its axial length.

As a result, the entire process of machining the workpiece 16 is shortened, and hence the workpiece 16 is machined at a reduced cost. Since dimensional variations in the diameter of the hole 51 which are caused when the spline slots 84 are formed can easily be corrected, the diameter of the hole 51 can be set to desired dimensions highly accurately.

The tooth profile forming apparatus 10 includes the process of forming the spline slots 84 in the inner circumferential surface of the hole 51 in the workpiece 16 and the process of correcting dimensional variations in the diameter of the hole 51 which are caused when the spline slots 84 are formed in the workpiece 16. These processes are successively performed in the same tooth profile forming apparatus 10 while the workpiece 16 is being retained in the workpiece cavity 66. Therefore, it is not necessary to deliver the workpiece 16 from one apparatus to another between these processes, and hence the workpiece 16 can be machined highly efficiently.

Although a certain preferred embodiment of the present invention has been shown and described in detail, it should be understood that various changes and modifications may be made therein without departing from the scope of the appended claims.

What is claimed is:

1. A method of forming a tooth profile, comprising the steps of:

inserting a punch into a hole in a workpiece and loading said workpiece in a body assembly;

pressing a splining segment of said punch into said hole in said workpiece by pressing said workpiece with a first die unit actuated by an actuator to cause material of said workpiece around said hole to plastically flow to form spline grooves in an inner circumferential surface of said hole;

holding an inner end face of said workpiece around said hole on an upper surface of a second die unit against displacement of said workpiece pressed by said first die unit, and pressing an outer circumferential edge portion of said workpiece by arbitrarily adjusting a pressure applied from said first die unit to said workpiece to generate a moment on said workpiece; and correcting the inner circumferential surface of said hole with said spline grooves formed therein from a shape progressively reduced and tapered upwardly into a shape substantially parallel to an axis of said hole so that said hole has a substantially constant diameter throughout its axial length between said first die unit and said second die unit.

2. A method according to claim 1, further comprising the step of, after the diameter of said hole is corrected, actuating a workpiece ejecting mechanism to displace said second die unit toward said workpiece to remove said workpiece from said body assembly.

3. A method according to claim 1, further comprising the steps of:

inserting a small-diameter segment of said punch into said hole in said workpiece when said punch is inserted into said hole; and thereafter, inserting a large-diameter segment of said punch, which is greater in diameter than said small-diameter segment, into said hole in said workpiece by pressing said workpiece with said first die unit, thereby enlarging said hole.

4. An apparatus for forming a tooth profile, comprising:

an actuator;

a first die unit which is axially displaceable by said actuator;

a second die unit disposed in a body assembly so as to axially face said first die unit, for holding an inner end face of said workpiece around a hole defined therein after said workpiece is axially displaced by said first die unit;

a punch disposed in said body assembly and having a splining segment having splining grooves defined in an outer circumferential surface thereof;

a workpiece cavity defined in said body assembly for being loaded with said workpiece having a hole, into which said punch inserts; and a ridge projecting from said first die unit towards said workpiece so as to axially face said outer circumferential edge portion of said workpiece, wherein while said end face of said workpiece around said hole is being held on said second die unit, said ridge of said first die unit is actuated by said actuator to press an outer circumferential edge portion of said workpiece towards said second die unit so as to displace said outer circumferential edge portion of said workpiece about said end face of said workpiece.

5. An apparatus according to claim 4, wherein said punch has an enlarged flange engaging said body assembly and a shank smaller in diameter than said enlarged flange, said shank including said splining segment, a large-diameter segment disposed more closely to said first die unit than said splining segment, a small-diameter segment disposed more closely to said first die unit than said large-diameter segment, and a guide segment disposed more closely to said second die unit than said splining segment, for axially guiding said second die unit.

6. An apparatus according to claim 5, wherein said guide segment, said splining segment, said large-diameter segment, and said small-diameter segment of said shank have respective diameters which are successively smaller, respectively.

7. An apparatus according to claim 6, wherein said splining segment has an axial length which is substantially equal to or slightly greater than an axial length of said hole in said workpiece.

8. An apparatus according to claim 4, wherein said second die unit comprises:

a first die fixed to said body assembly; and a second die disposed radially inwardly of said first die for displacement along said punch;

wherein said first die has a first engaging portion on an inner circumferential surface thereof for engaging a second engaging portion on an outer circumferential surface of said second die when said second die is displaced with respect to said first die.

9. An apparatus according to claim 8, wherein said workpiece cavity is formed of said first die unit, said first die, and an outer ring disposed around said first die.

10. An apparatus according to claim 9, wherein said outer ring has an inner circumferential surface having a diameter which is essentially the same as the diameter of the outer circumferential surface of said workpiece.

11. An apparatus according to claim 9, further comprising a workpiece ejecting mechanism mounted in said body assembly for removing said workpiece from said workpiece cavity.

12. An apparatus for forming a tooth profile, comprising:

an actuator;

a body assembly for being loaded with a workpiece;

a first die unit which is axially displaceable by said actuator;

a second die unit disposed in said body assembly so as to axially face said first die unit, for holding an end face of said workpiece around a hole defined therein after said workpiece is axially displaced by said first die unit; and a punch disposed in said body assembly and having a splining segment having splining grooves defined in an outer circumferential surface thereof, wherein while said end face of said workpiece around said hole is being held on said second die unit, said first die unit is actuated by said actuator to press an outer circumferential edge portion of said workpiece toward said second die unit, wherein said punch has an enlarged flange engaging said body assembly and a shank smaller in diameter than said enlarged flange, said shank including said splining segment, a large-diameter segment disposed more closely to said first die unit than said splining segment, a small-diameter segment disposed more closely to said first die unit than said large-diameter segment, and a guide segment disposed more closely to said second die unit than said splining segment, for axially guiding said second die unit.

13. An apparatus according to claim 12, wherein said guide segment, said splining segment, said large-diameter segment, and said small-diameter segment of said shank have respective diameters which are successively smaller, respectively.

14. An apparatus according to claim 13, wherein said splining segment has an axial length which is substantially equal to or slightly greater than an axial length of said hole in said workpiece.

15. An apparatus for forming a tooth profile, comprising:

an actuator;

a body assembly for being loaded with a workpiece;

a first die unit which is axially displaceable by said actuator;

a second die unit disposed in said body assembly so as to axially face said first die unit, for holding an end face of said workpiece around a hole defined therein after said workpiece is axially displaced by said first die unit; and a punch disposed in said body assembly and having a splining segment having splining grooves defined in an outer circumferential surface thereof; and wherein while said end face of said workpiece around said hole is being held on said second die unit, said first die unit is actuated by said actuator to press an outer circumferential edge portion of said workpiece toward said second die unit, wherein said second die unit comprises:

a first die fixed to said body assembly; and a second die disposed radially inwardly of said first die for displacement along said punch, wherein said first die has a first engaging portion on an inner circumferential surface thereof for engaging a second engaging portion on an outer inner circumferential surface of said second die when said second die is displaced with respect to said first die, wherein an outer ring is disposed around said first die, said second die, and said first die unit, and wherein said outer ring partially defines a workpiece cavity for being loaded with said workpiece, and wherein said outer ring has an inner circumferential surface having a diameter which is essentially the same as the diameter of the outer circumferential surface of said workpiece.

* * * * *